US011585563B2

(12) United States Patent
Mitsui et al.

(10) Patent No.: US 11,585,563 B2
(45) Date of Patent: Feb. 21, 2023

(54) AIR-CONDITIONING REGISTER

(71) Applicant: TOYODA GOSEI CO., LTD., Kiyosu (JP)

(72) Inventors: Yasuyuki Mitsui, Kiyosu (JP); Hiroto Watanabe, Kiyosu (JP)

(73) Assignee: TOYODA GOSEI CO., LTD., Aichi-pref. (JP)

( * ) Notice: Subject to any disclaimer, the term of this patent is extended or adjusted under 35 U.S.C. 154(b) by 0 days.

(21) Appl. No.: 17/411,380

(22) Filed: Aug. 25, 2021

(65) Prior Publication Data

US 2022/0065491 A1 Mar. 3, 2022

(30) Foreign Application Priority Data

Aug. 31, 2020 (JP) ..... JP2020-145204

(51) Int. Cl.
*F24F 13/08* (2006.01)

(52) U.S. Cl.
CPC ..... *F24F 13/082* (2013.01)

(58) Field of Classification Search
CPC ..... B60H 1/34–3492
USPC ..... 454/152–155
See application file for complete search history.

(56) References Cited

U.S. PATENT DOCUMENTS

2019/0047375 A1* 2/2019 Ito ..... B60H 1/3421
2019/0061475 A1* 2/2019 Ito ..... B60H 1/3421

FOREIGN PATENT DOCUMENTS

DE 102010023528 A1 * 6/2011 ..... B60H 1/3421
DE 102017008821 A1 * 3/2018
ES 2328636 T3 * 11/2009 ..... B60H 1/3428
JP 2006-123616 A 5/2006

* cited by examiner

*Primary Examiner* — Edelmira Bosques
*Assistant Examiner* — Michael James Giordano
(74) *Attorney, Agent, or Firm* — Posz Law Group, PLC

(57) ABSTRACT

An air-conditioning register includes: a downstream fin; and an upstream fin. The downstream fin and the upstream fin are provided in a ventilation passage which allows air-conditioning air to flow. The downstream fin is rotatable around a center line of a first rotation shaft. The upstream fin is rotatable around a center line of a second rotation shaft further on an upstream side than the downstream fin in the ventilation passage. The second rotation shaft extends in a direction different from that of the first rotation shaft. The downstream fin is slidable in a center line direction of the first rotation shaft and has a driving unit which presses the upstream fin in a slide movement direction as the downstream fin slides.

2 Claims, 12 Drawing Sheets

AIR-CONDITIONING REGISTER

CROSS-REFERENCE TO RELATED APPLICATION(S)

This application is based upon and claims the benefit of priority from prior Japanese patent application No. 2020-145204 filed on Aug. 31, 2020, the entire contents of which are incorporated herein by reference.

BACKGROUND

1. Field of the Invention

The present invention relates to an air-conditioning register.

2. Description of the Related Art

Vehicles such as automobiles are provided with an air-conditioning register which blows air-conditioning air from an air-conditioning device into a passenger compartment. The air-conditioning register is for adjusting a blowing direction of the air-conditioning air and is provided with a downstream fin and an upstream fin provided in a ventilation passage through which the air-conditioning air flows. The downstream fin is rotatable around a center line of a first rotation shaft. In addition, the upstream fin can rotate around a center line of a second rotation shaft further on an upstream side than the downstream fin in the ventilation passage. The second rotation shaft extends in a direction different from that of the first rotation shaft.

A direction of air-conditioning air blown out from the ventilation passage of the air-conditioning register into the passenger compartment is adjusted by changing rotation positions of the downstream fin and upstream fin. An air-conditioning register of JP-A-2006-123616 is provided with a knob for performing both a rotation operation of the downstream fin and a rotation operation of the upstream fin. This knob is attached to the downstream fin so that the knob can move integrally in the direction of rotation. Therefore, a user can rotate the downstream fin by holding the knob and rotating (hereinafter referred to as a first operation) the knob in the rotation direction of the downstream fin.

In addition, the knob can rotate with respect to the downstream fin around a center line orthogonal to the rotation direction of the downstream fin. The downstream fin is equipped with a slider which slides in an extending direction of the first rotation shaft as the knob rotates. This slider presses the upstream fin in the same slide movement direction as the slide moves. Therefore, a user can rotate the upstream fin via the slider by holding the knob and rotating (hereinafter referred to as a second operation) the knob around the center line.

In the air-conditioning register of JP-A-2006-123616, both the rotation operation of the downstream fin and the rotation operation of the upstream fin can be performed by the first operation and the second operation of the knob provided on the downstream fin. However, the provision of the knob on the downstream fin reduces a flow cross-sectional area of the air-conditioning air blown into the passenger compartment from the ventilation passage in the air-conditioning register, and along with this, a pressure loss when the air-conditioning air passes through the air-conditioning register increases.

SUMMARY

An object of the invention is to provide an air-conditioning register capable of suppressing a decrease in a flow cross-sectional area of air-conditioning air.

Hereinafter, means for solving the above problems and their actions and effects will be described.

According to an aspect of the invention, there is provided an air-conditioning register including: a downstream fin; and an upstream fin, where: the downstream fin and the upstream fin are provided in a ventilation passage which allows air-conditioning air to flow; the downstream fin is rotatable around a center line of a first rotation shaft; the upstream fin is rotatable around a center line of a second rotation shaft further on an upstream side than the downstream fin in the ventilation passage; the second rotation shaft extends in a direction different from that of the first rotation shaft; and the downstream fin is slidable in a center line direction of the first rotation shaft and has a driving unit which presses the upstream fin in a slide movement direction as the downstream fin slides.

According to the configuration described above, a user holds the downstream fin by hand and rotates the downstream fin around the center line of the first rotation shaft to perform the rotation operation of the downstream fin to adjust the blowing direction of the air-conditioning air. Also, when performing the rotation operation of the upstream fin, the user holds the downstream fin by hand and slides the downstream fin in the center line direction of the first rotation shaft. Along with the slide movement of the downstream fin, the upstream fin is pressed in the slide movement direction by the driving unit of the downstream fin. As a result, the upstream fin is rotated to adjust the blowing direction of the air-conditioning air. In this way, since the rotation operation of the downstream fin and the upstream fin is performed by the rotation and the slide movement of the downstream fin, it is not necessary to attach a knob or the like for performing the rotation operation to the downstream fin. Therefore, it is possible to suppress a decrease in a flow cross-sectional area of the air-conditioning air blown out from the ventilation passage in the air-conditioning register into a passenger compartment, which is caused by attaching the knob or the like to the downstream fin.

In the air-conditioning register according to the aspect of the invention, at a downstream end of the downstream fin, a grip portion having a thickness equal to or less than a thickness of the downstream fin may be formed so as to protrude.

This configuration makes it easier for a user to hold the grip portion of the downstream fin by hand. Therefore, this makes it easier for the user to hold the grip portion by hand to rotate or slide the downstream fin. In addition, since the thickness of the grip portion is equal to or less than the thickness of the downstream fin, the grip portion does not reduce the flow cross-sectional area of the air-conditioning air in the air-conditioning register.

In the air-conditioning register according to the aspect of the invention, the downstream fin may be supported by a rotation support portion so as to be rotatable around the center line of the first rotation shaft and may be supported by a slide support portion so as to be slidable in the center line direction of the first rotation shaft, and the rotation support portion and the slide support portion may be provided at different positions.

Regarding the rotation and slide movement of the downstream fin by the user operation, it is advantageous to perform each of them against a certain amount of reaction force in order to precisely adjust the position of the downstream fin during the rotation and slide movement. However, when the reaction force acting on the downstream fin during the rotation and the reaction force acting on the downstream fin during the slide movement are significantly different, the difference in the magnitude of the reaction force appears as a difference in the operation feeling of the downstream fin by a user, which causes the user to feel a sense of discomfort. In order to suppress such a situation, it is necessary to adjust the rotation support portion and the slide support portion so that the difference in the magnitude of the reaction force can be suppressed to a small extent. However, when the rotation support portion and the slide support portion are provided at the same position, it becomes difficult to perform such adjustment. According to the configuration described above, since the rotation support portion and the slide support portion are provided at different positions, it becomes easy to adjust the rotation support portion and the slide support portion so that the difference in the magnitude of the reaction force can be suppressed to a small extent.

In the air-conditioning register described above, the first rotation shaft, the ventilation passage, the downstream fin, the rotation support portion, and the slide support portion may be as follows. The first rotation shaft may be fixed to the downstream fin, the ventilation passage may be formed in a retainer, the retainer may be formed with a slide hole which supports a slider so that the slider can be slidably moved in the center line direction of the first rotation shaft, the slider may be formed with a rotation hole which rotatably supports the first rotation shaft, the downstream fin may be supported by the retainer via the first rotation shaft and the slider, the rotation support portion may be formed by the first rotation shaft and the rotation hole of the slider, and the slide support portion may be formed by the slider and the slide hole of the retainer.

According to the configuration described above, magnitude of a reaction force during the rotation operation of the downstream fin can be adjusted by, for example, adjusting the frictional resistance between the first rotation shaft and the rotation hole of the slider. In addition, magnitude of a reaction force during the slide movement operation of the downstream fin can be adjusted by, for example, adjusting the frictional resistance between the slider and the slide hole of the retainer.

In the air-conditioning register described above, the ventilation passage, the first rotation shaft, the downstream fin, the rotation support portion, and the slide support portion may be as follows. The ventilation passage may be formed in a retainer, the first rotation shaft may be fixed to a tubular body supported by the retainer, the retainer may be formed with a rotation hole which rotatably supports the first rotation shaft, the tubular body may be formed with a slide cavity in which the downstream fin is inserted so that the downstream fin is supported so as to be slidable in the center line direction of the first rotation shaft, the downstream fin may be supported by the retainer via the tubular body and the first rotation shaft, the rotation support portion may be formed by the first rotation shaft and the rotation hole of the retainer, and the slide support portion may be formed by the slide cavity of the tubular body.

According to the configuration described above, magnitude of a reaction force during the rotation operation of the downstream fin can be adjusted by, for example, adjusting the frictional resistance between the first rotation shaft and the rotation hole of the retainer. In addition, magnitude of a reaction force during the slide movement operation of the downstream fin can be adjusted by, for example, adjusting the frictional resistance between the downstream fin and the slide cavity of the tubular body.

In the air-conditioning register described above, the downstream fin, the first rotation shaft, the ventilation passage, the rotation support portion, and the slide support portion may be as follows. The downstream fin may be formed with a slide groove in which the first rotation shaft is fitted so as to be slidable in the center line direction, the ventilation passage may be formed in a retainer, the retainer may be formed with a rotation cavity which rotatably supports the first rotation shaft, the downstream fin may be supported by the retainer via the first rotation shaft, the rotation support portion may be formed by the first rotation shaft and the rotation cavity of the retainer, and the slide support portion may be formed by the first rotation shaft and the slide groove of the downstream fin.

According to the configuration described above, magnitude of a reaction force during the rotation operation of the downstream fin can be adjusted by, for example, adjusting the frictional resistance between the first rotation shaft and the rotation cavity of the retainer. In addition, magnitude of a reaction force during the slide movement operation of the downstream fin can be adjusted by, for example, the frictional resistance between the first rotation shaft and the slide groove of the downstream fin.

BRIEF DESCRIPTION OF THE DRAWINGS

The present invention will become more fully understood from the detailed description given hereinbelow and the accompanying drawing which is given by way of illustration only, and thus is not limitative of the present invention and wherein.

DETAILED DESCRIPTION OF THE INVENTION

First Embodiment

Hereinafter, a first embodiment of an air-conditioning register will be described with reference to FIGS. 1 to 7.

Figure 1:
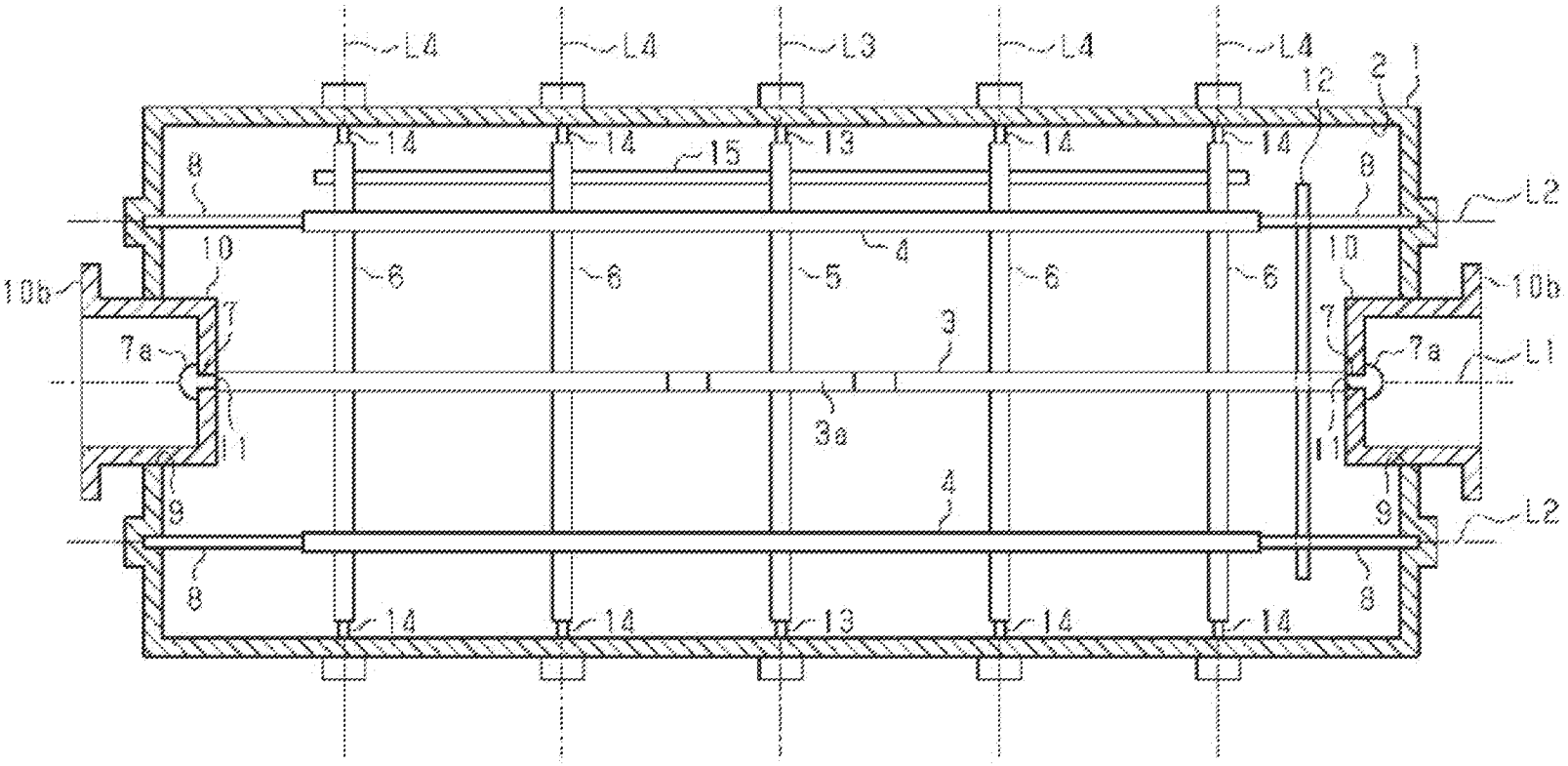
FIG. 1 is a cross-sectional view illustrating an air-conditioning register.

The air-conditioning register illustrated in FIG. 1 is for blowing out air-conditioning air from an air-conditioning device of a vehicle into a passenger compartment and adjusting a blowing direction of the air-conditioning air. The air-conditioning register includes a retainer 1 having a square tubular shape. Inside the retainer 1, a ventilation passage 2 for flowing the air-conditioning air is formed. The air-conditioning air in the ventilation passage 2 flows from a back side in a direction orthogonal to a paper surface of FIG. 1 toward a front side. The air-conditioning register also includes a plurality of downstream fins 3 and 4 and a plurality of upstream fins 5 and 6 provided in the ventilation passage 2 of the retainer 1.

The downstream fins 3 and 4 are formed in a plate shape extending in a left-right axial direction in FIG. 1. The plurality of downstream fins 3 and 4 are arranged at predetermined intervals in an up-down axial direction of FIG. 1. Specifically, of the plurality of downstream fins 3 and 4, the downstream fin 3 is located in a center and the downstream fins 4 are located on both sides of the downstream fin 3 in the up-down axial direction. At a downstream end of the downstream fin 3 and at a center of the downstream fin 3 in the left-right axial direction, a grip portion 3*a* having a thickness equal to the thickness of the downstream fin 3 is formed so as to protrude toward a downstream side. The downstream fins 3 and 4 are rotatable around center lines L1 and L2 of rotation shafts 7 and 8 extending in the left-right axial direction in FIG. 1.

The rotation shafts 7 are respectively fixed to both left and right ends of the downstream fin 3. This rotation shaft 7 plays a role as a first rotation shaft. The rotation shafts 7 at both the left and right ends of the downstream fin 3 are arranged so as to extend on the same axis. Further, a slide hole 9 is formed in a portion of the retainer 1 facing the rotation shaft 7. A slider 10 having a tubular shape is inserted into the slide hole 9. By being supported by the slide hole 9, the slider 10 can slide and move in a center line L1 direction of the rotation shaft 7 with respect to the retainer 1. A flange 10*b* is formed at an end portion of the slider 10 located outside the retainer 1. The flange 10*b* is for regulating excessive slide movement of the retainer 1. Further, the slider 10 is also set so as not to rotate around the center line L1 of the rotation shaft 7 with respect to the retainer 1.

The slider 10 is formed with a rotation hole 11 which rotatably supports the rotation shaft 7. The rotation shaft 7 penetrates the rotation hole 11. Further, a large diameter portion 7*a* is formed at a tip of the rotation shaft 7 so as to interpose a periphery of the rotation hole 11 in the slider 10 with an end portion of the downstream fin 3. In this way, the periphery of the rotation hole 11 in the slider 10 is interposed between the end portion of the downstream fin 3 and the large diameter portion 7*a* of the rotation shaft 7, whereby the rotation shaft 7 is prevented from sliding in the center line L1 direction with respect to the slider 10.

In the air-conditioning register, the downstream fin 3 is supported by the retainer 1 via the rotation shaft 7 and the slider 10. In the air-conditioning register, a rotation support portion which supports the downstream fin 3 such that the downstream fin 3 is rotatable around the center line L1 of the rotation shaft 7 is formed by the rotation shaft 7 and the rotation hole 11 of the slider 10. Further, in the air-conditioning register, a slide support portion which supports the downstream fin 3 such that the downstream fin 3 is slidable in the center line L1 direction of the rotation shaft 7 is formed by the slider 10 and the slide hole 9 of the retainer 1. Therefore, the rotation support portion and the slide support portion are provided at different positions of the air-conditioning register.

The rotation shafts 8 are respectively fixed to both left and right ends of the downstream fin 4. The rotation shafts 8 at both the left and right ends of the downstream fin 4 are arranged so as to extend on the same axis. Further, the rotation shaft 8 is attached so as to be rotatable around the center line L2 with respect to the retainer 1 and not to be slidable in a center line L2 direction of the rotation shaft 8. The plurality of downstream fins 3 and 4 are connected to each other via a link 12. Then, when the downstream fin 3 is rotated around the center line L1 of the rotation shaft 7, the rotation is transmitted to the downstream fin 4 via the link 12 and the downstream fin 4 rotates around the center line L2 of the rotation shaft 8 in the same manner as the rotation of the downstream fin 3.

The upstream fins 5 and 6 are formed in a plate shape extending in the up-down axial direction of FIG. 1. The plurality of upstream fins 5 and 6 are arranged at predetermined intervals in the left-right axial direction of FIG. 1. Specifically, of the plurality of upstream fins 5 and 6, the upstream fin 5 is located in the center and the upstream fins 6 are located on both sides of the upstream fin 5 in the left-right axial direction. The upstream fins 5 and 6 are rotatable around center lines L3 and L4 of rotation shafts 13 and 14 extending in the up-down axial direction of FIG. 1.

The rotation shafts 13 are respectively fixed to upper and lower ends of the upstream fin 5. The rotation shaft 13 is in a twisted position with respect to the rotation shaft 7 and serves as a second rotation shaft extending in a different direction at a position away from the first rotation shaft (rotation shaft 7). The rotation shafts 13 at the upper and lower ends of the upstream fin 5 are arranged so as to extend on the same axis. Further, the rotation shaft 13 is attached to the retainer 1 so as to rotatable around the center line L3. With slide movement of the rotation shaft 7 in the downstream fin 3 in the center line L1 direction, the upstream fin 5 is pushed by the downstream fin 3 and rotates around the center line L3 of the rotation shaft 13.

The rotation shafts 14 are respectively fixed to upper and lower ends of the upstream fin 6. The rotation shafts 14 at the upper and lower ends of the upstream fin 5 are arranged so as to extend on the same axis. Further, the rotation shaft 14 is attached to the retainer 1 so as to be rotatable around the center line L4. The plurality of upstream fins 5 and 6 are connected to each other via a link 15. Then, when the upstream fin 5 rotates around the center line L3 of the rotation shaft 8, the rotation is transmitted to the upstream fin 6 via the link 15, so that the upstream fin 6 rotates around the center line L4 of the rotation shaft 14 in the same manner as the rotation of the upstream fin 5.

Next, details of a connection structure of the plurality of downstream fins 3 and 4 by the links 12 and details of a structure of the upstream fin 5 will be described.

Figure 2:
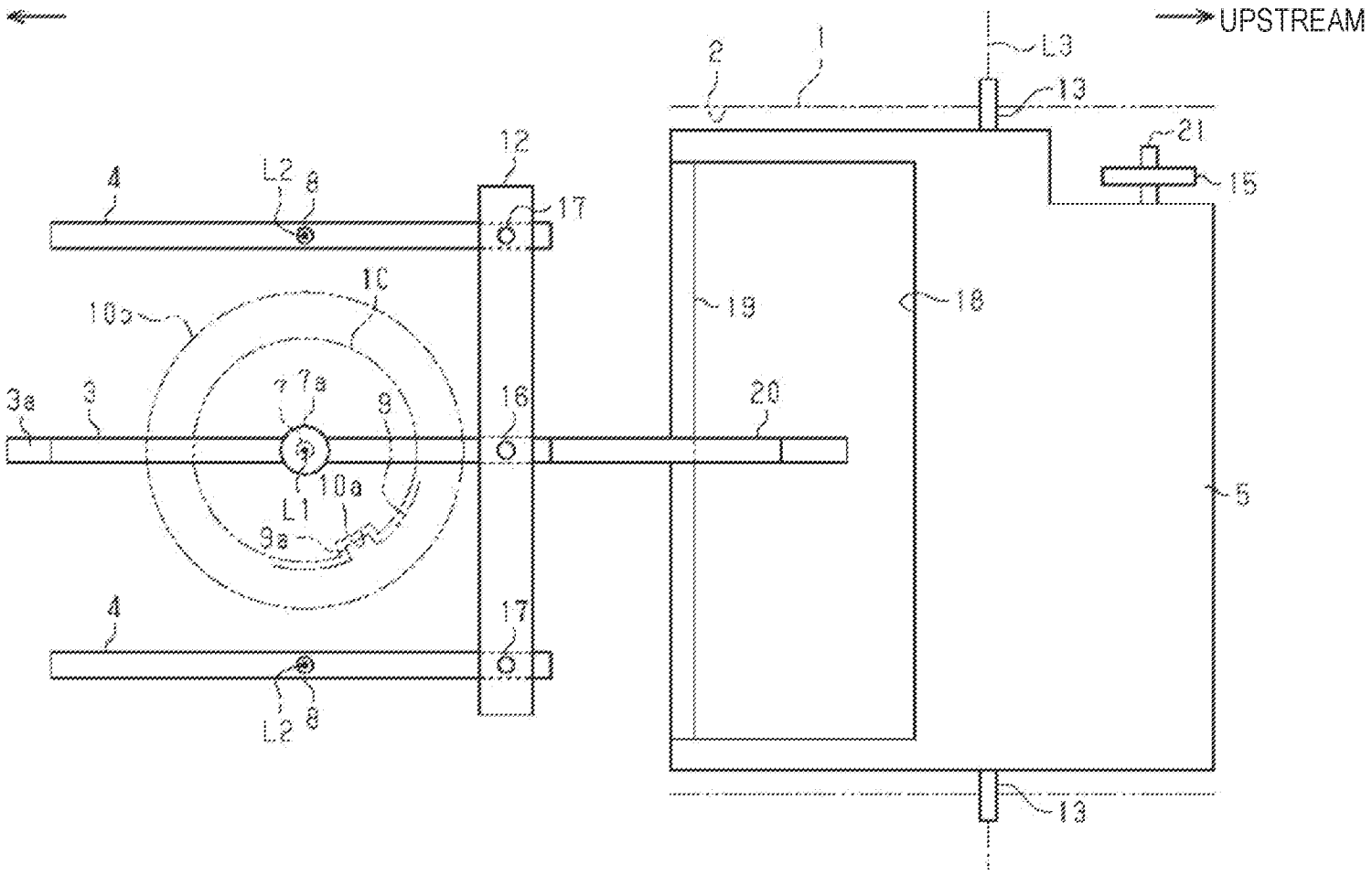
FIG. 2 is a side view illustrating a downstream fin and an upstream fin.

As illustrated in FIG. 2, the downstream fin 3 is supported by the slide hole 9 of the retainer 1 via the rotation shaft 7 and the slider 10. A protrusion portion 9*a* is formed on an inner peripheral surface of the slide hole 9. The slider 10 is formed with a recess portion 10*a* extending in the same direction as the rotation shaft 7. The protrusion portion 9*a* is inserted into the recess portion 10*a*. Then, by these recess portions 10*a* and protrusion portions 9*a*, the slider 10 can slide in the center line L1 direction (the direction orthogonal to the paper surface in FIG. 2) of the rotation shaft 7 and is prevented from rotating around the center line L1 of the rotation shaft 7.

A connection shaft 16 is formed further on the upstream side (right side in FIG. 2) than the rotation shaft 7 in the downstream fin 3 so as to be parallel to the rotation shaft 7. Further, a connection shaft 17 is formed further on the upstream side than the rotation shaft 8 in the downstream fin 4 so as to be parallel to the rotation shaft 8. These connection shafts 16 and 17 penetrate the link 12 extending in the up-down axial direction of FIG. 2 and are rotatably connected to the link 12. Further, the connection shaft 17 can move relative to the link 12 in a center line direction of the connection shaft 17.

Figure 3:
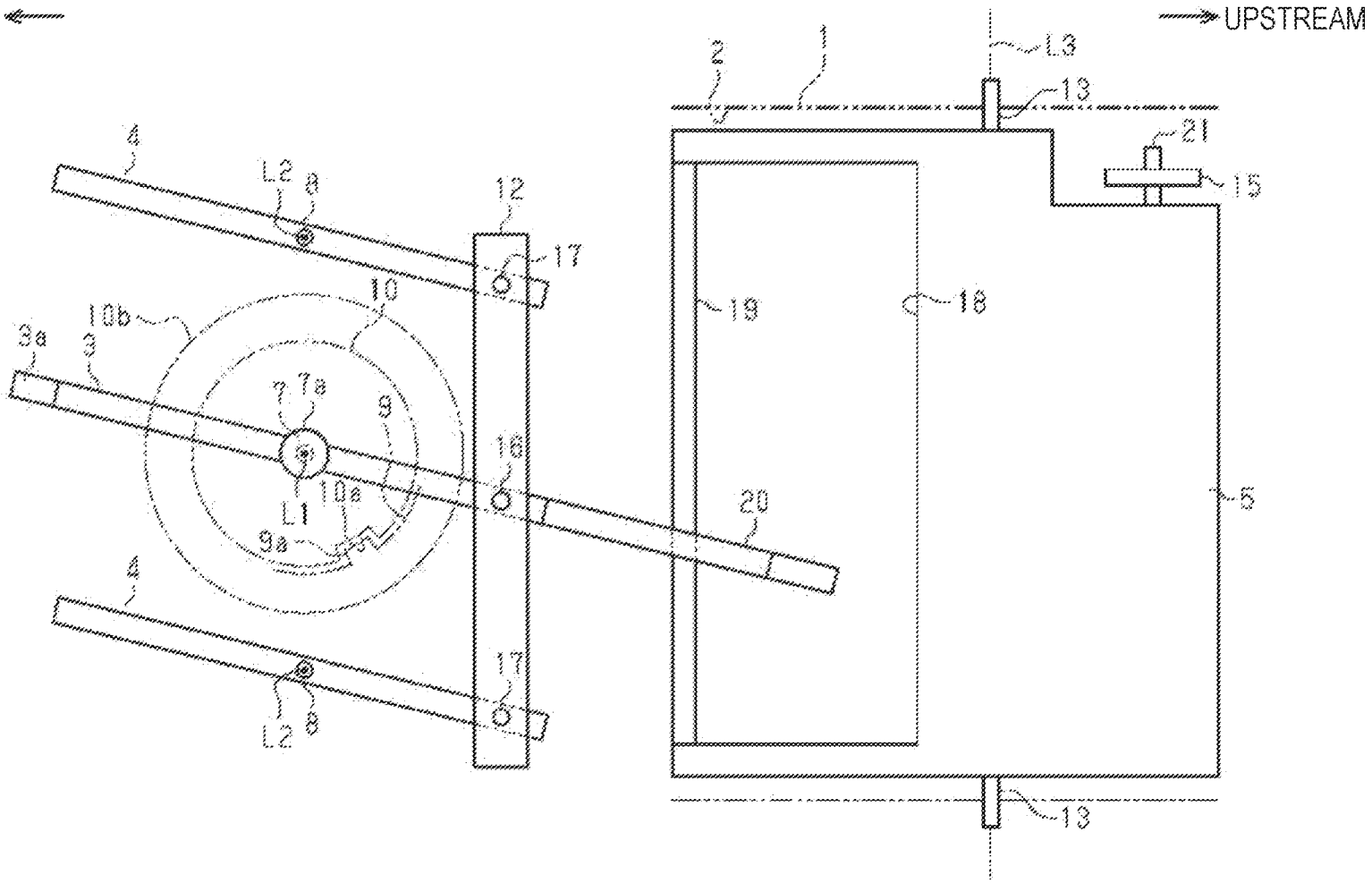
FIG. 3 is a side view illustrating the downstream fin and the upstream fin.
Figure 4:
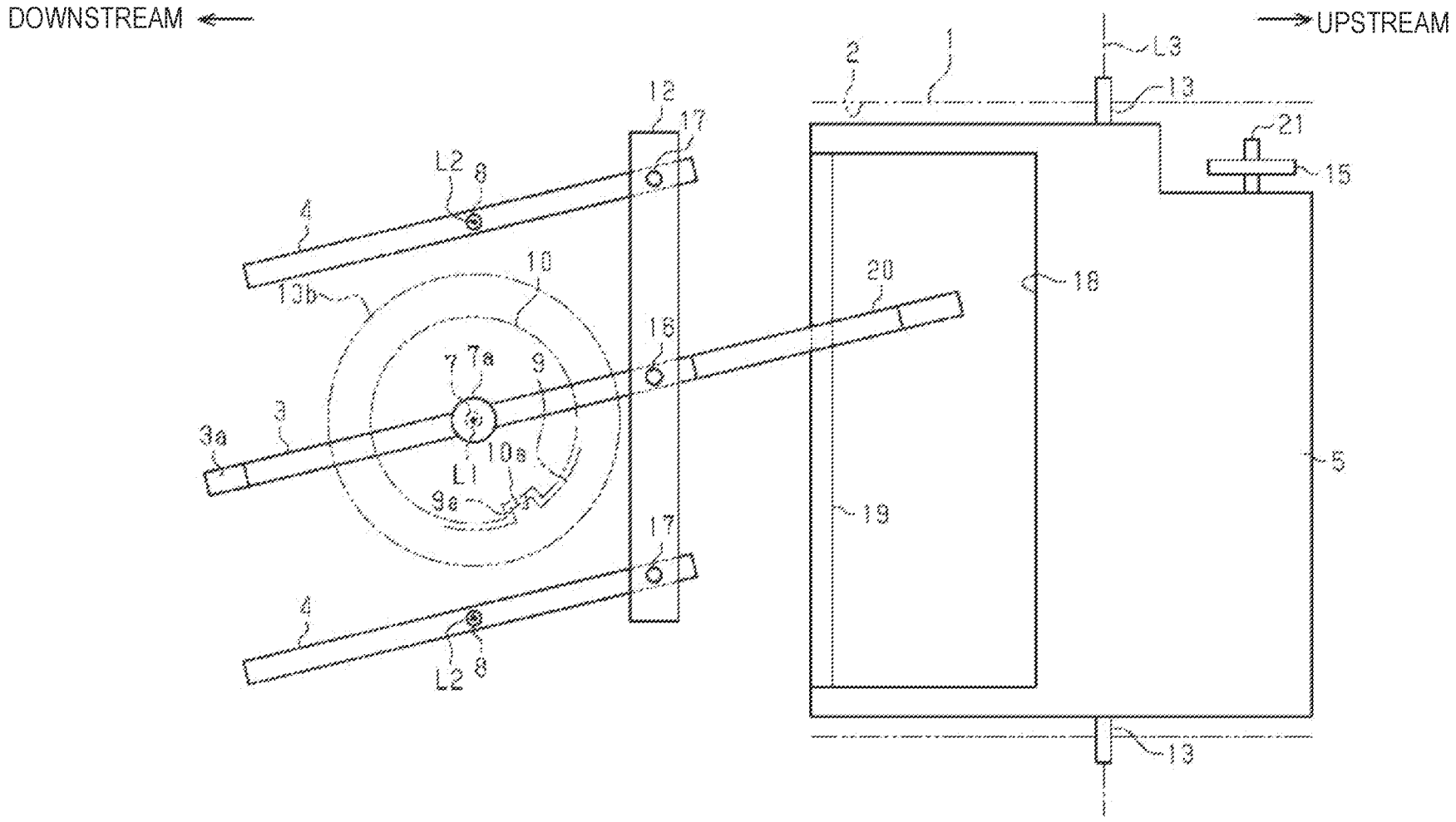
FIG. 4 is a side view illustrating the downstream fin and the upstream fin.

As illustrated in FIGS. 3 and 4, when the downstream fin 3 rotates around the center line L1 of the rotation shaft 7, the rotation is transmitted to the downstream fin 4 via the connection shaft 16, the link 12, and the connection shaft 17. As a result, the downstream fin 4 rotates around the center line L2 of the rotation shaft 8 in the same way that the downstream fin 3 rotates around the center line L1 of the rotation shaft 7.

A space portion 18 is formed in a portion on the downstream side (left side of FIGS. 2 to 4) of the upstream fin 5 so as to penetrate the upstream fin 5 in a thickness direction (direction orthogonal to the paper surface of FIGS. 2 to 4). A connection bar 19 extending in the up-down axial direction is provided at an upstream end of the upstream fin 5, that is, a portion on the downstream side in the space portion 18. The connecting bar 19 is for receiving pressure from the downstream fin 3 in the slide movement direction when the downstream fin 3 slides in the center line L1 direction of the rotation shaft 7.

Next, details of a connection structure of the plurality of upstream fins 5 and 6 by the links 15 and details of a connection structure of the upstream fin 5 and the downstream fin 3 will be described.

Figure 5:
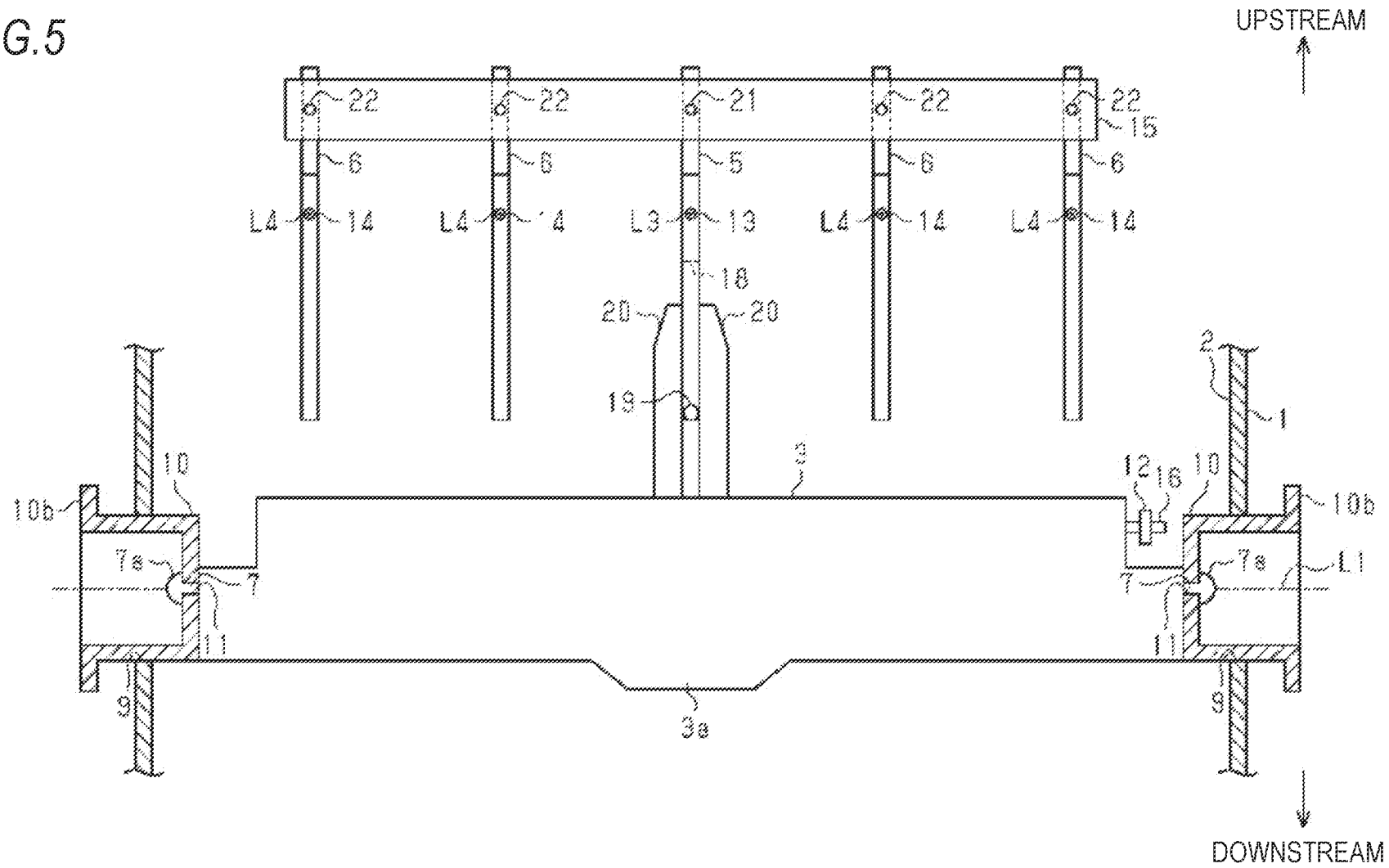
FIG. 5 is a plan view illustrating the downstream fin and the upstream fin.

As illustrated in FIG. 5, a pair of forks 20 protruding toward the upstream side are formed at an upstream end (upper end in FIG. 5) of the downstream fin 3 and a central portion in the left-right axial direction in FIG. 5. The pair of forks 20 are located so as to interpose the connection bar 19 of the upstream fin 5. The fork 20 functions as a driving unit which presses the upstream fin 5 in the same slide movement direction as the downstream fin 3 slides in the center line L1 direction of the rotation shaft 7.

A connection shaft 21 is formed further on the upstream side than the rotation shaft 13 in the upstream fin 5 so as to be parallel to the rotation shaft 13. Further, a connection shaft 22 is formed further on the upstream side than the rotation shaft 14 in the upstream fin 5 so as to be parallel to the rotation shaft 14. These connection shafts 21 and 22 penetrate the link 15 extending in the left-right axial direction of FIG. 5 and are rotatably connected to the link 15.

Figure 6:
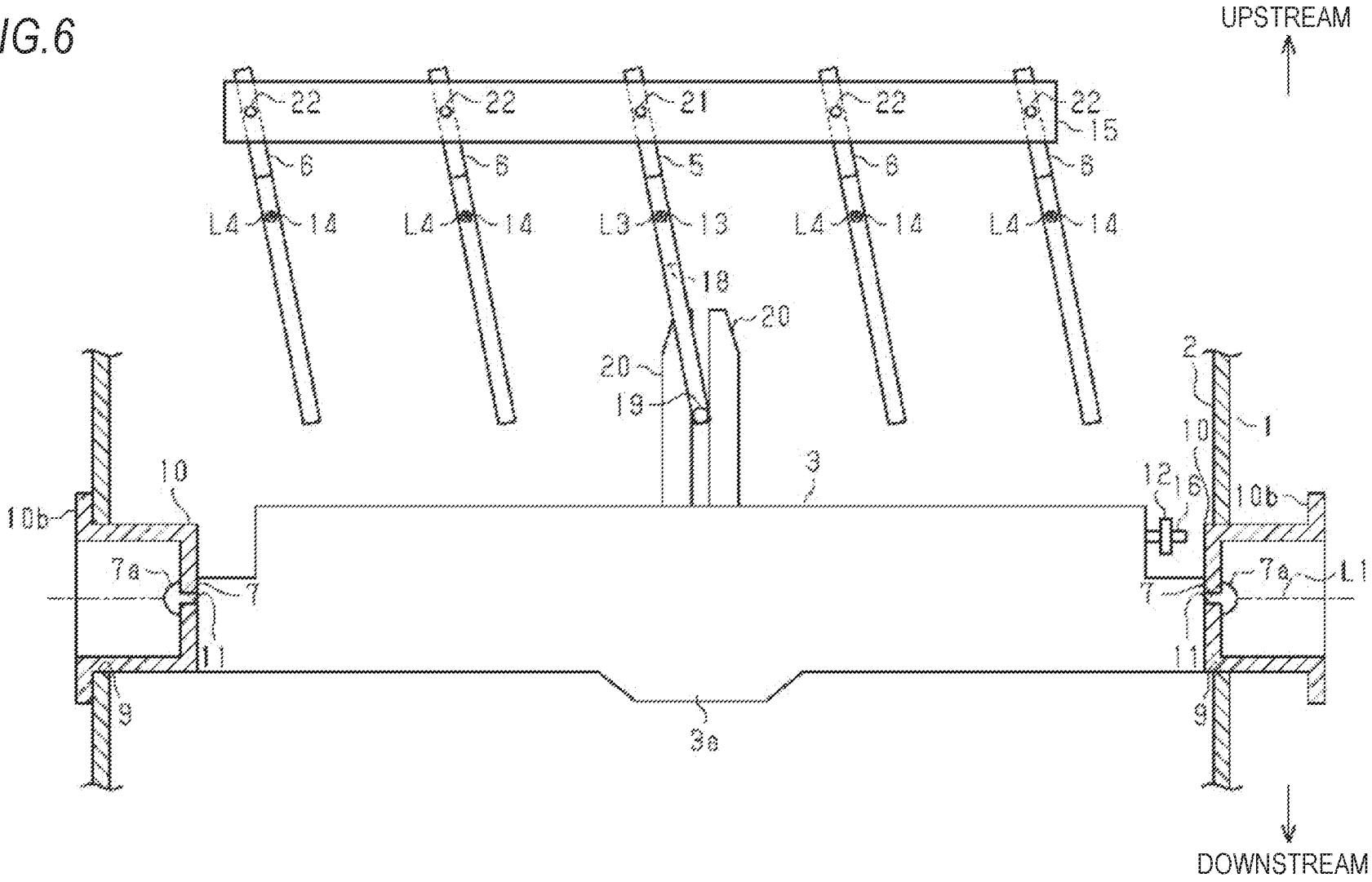
FIG. 6 is a plan view illustrating the downstream fin and the upstream fin.
Figure 7:
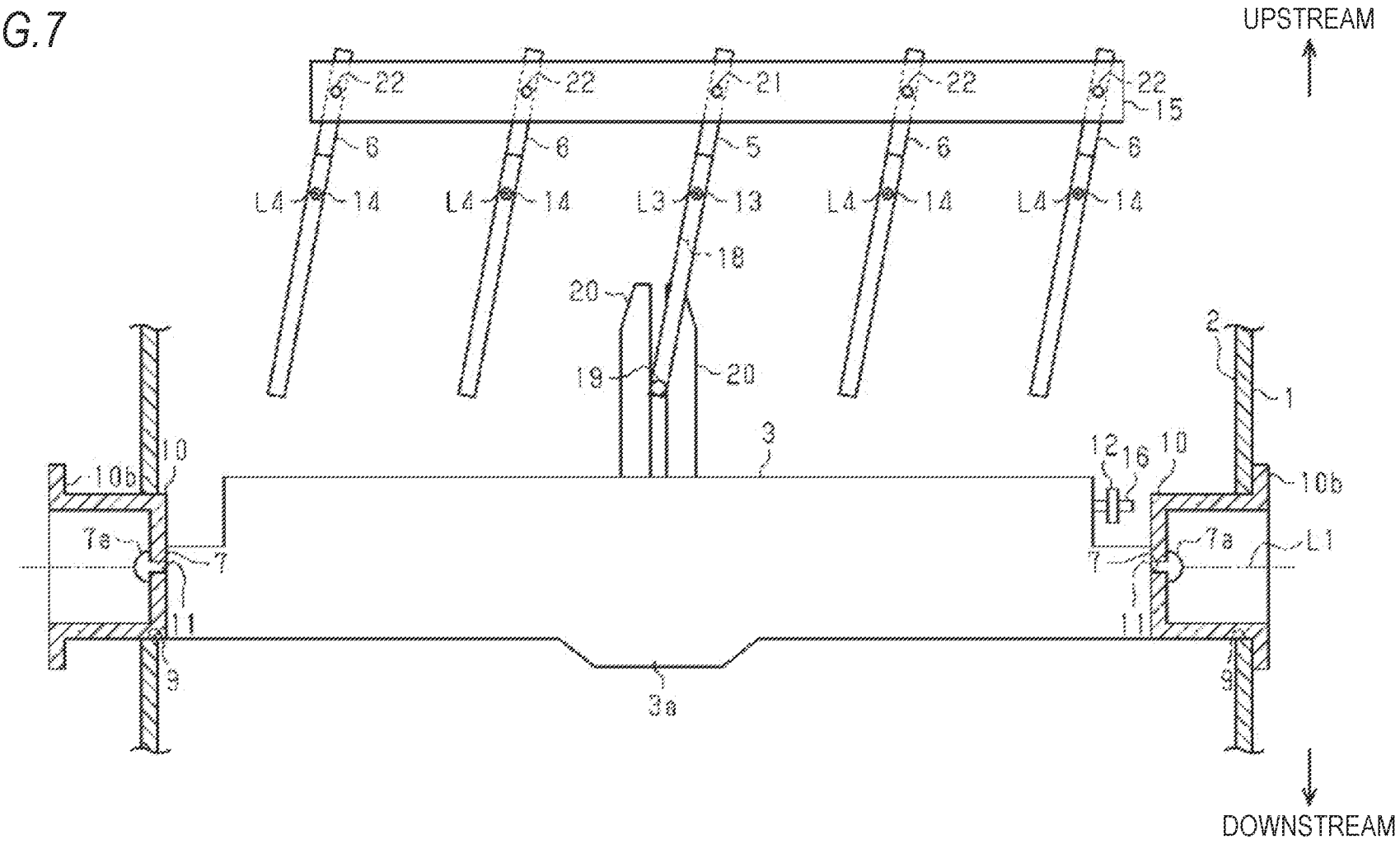
FIG. 7 is a plan view illustrating the downstream fin and the upstream fin.

As illustrated in FIGS. 6 and 7, when the downstream fin 3 slides in the center line L1 direction of the rotation shaft 7, the fork 20 of the downstream fin 3 presses the connection bar 19 of the upstream fin 5 in the slide movement direction. With such pressing, the upstream fin 5 rotates around the center line L3 of the rotation shaft 13. In this case, when the upstream fin 5 is rotated, the pair of forks 20 is prevented from coming into contact with a portion of the upstream fin 5 other than the connection bar 19 by the space portion 18 of the upstream fin 5.

When the upstream fin 5 rotates around the center line L3 of the rotation shaft 14, the rotation is transmitted to the upstream fin 6 via the connection shaft 21, the link 15, and the connection shaft 22. As a result, the upstream fin 6 rotates around the center line L4 of the rotation shaft 14 in the same manner as the upstream fin 5 rotates around the center line L3 of the rotation shaft 13.

Next, an operation of the air-conditioning register of this embodiment will be described.

When adjusting a blowing direction of air-conditioning air from the air-conditioning register (ventilation passage 2) in the up-down axial direction of FIG. 1, a user holds the grip portion 3*a* by hand and rotates the downstream fin 3 around the center line L1 of the rotation shaft 7. Such rotation of the downstream fin 3 is realized through the rotation of the rotation shaft 7 with respect to the rotation hole 11 of the slider 10. Further, in this case, in conjunction with the rotation of the downstream fin 3, the downstream fin 4 also rotates around the center line L2 of the rotation shaft 8. Therefore, the user can adjust the blowing direction of the air-conditioning air from the ventilation passage 2 in the up-down axial direction by rotating the downstream fin 3.

When adjusting the blowing direction of the air-conditioning air from the air-conditioning register in the left-right axial direction in FIG. 2, the user holds the grip portion 3*a* by hand and slides the downstream fin 3 in the center line L1 direction of the rotation shaft 7. Such slide movement of the downstream fin 3 is realized through the slide movement of the slider 10 in the center line L1 direction of the rotation shaft 7 with respect to the slide hole 9 of the retainer 1.

Then, when the downstream fin 3 slides, the fork 20 of the downstream fin 3 presses the connection bar 19 of the upstream fin 5 in the slide movement direction. As a result, the upstream fin 5 rotates around the center line L3 of the rotation shaft 13 and the upstream fin 6 rotates around the center line L4 of the rotation shaft 14 in conjunction with the rotation. By sliding the downstream fin 3, the user performs a rotation operation of the upstream fins 5 and 6 for adjusting the blowing direction of the air-conditioning air in the left-right axial direction. Therefore, the user can adjust the blowing direction of the air-conditioning air from the ventilation passage 2 in the left-right axial direction by the slide movement operation of the downstream fin 3.

According to the embodiment described in detail above, the following effects can be obtained.

(1) The rotation of the downstream fin 3 causes the downstream fins 3 and 4 to be rotated and the slide movement of the downstream fin 3 causes the upstream fins 5 and 6 to be rotated. Therefore, it is not necessary to attach a knob or the like for rotating the downstream fins 3 and 4 and the upstream fins 5 and 6 to the downstream fin 3. Therefore, it is possible to suppress a decrease in a flow cross-sectional area of the air-conditioning air blown out from the ventilation passage 2 in the air-conditioning register into the passenger compartment, which is caused by attaching the knob or the like to the downstream fin 3.

(2) At the downstream end of the downstream fin 3, the grip portion 3*a* is formed so as to protrude toward the downstream side. This makes it easier for a user to hold the grip portion 3*a* by hand when rotating or sliding the downstream fin 3. Therefore, it becomes easy for the user to hold the grip portion 3*a* by hand and rotate or slide the downstream fin 3. Also, since the thickness of grip portion 3*a* is the same as the thickness of downstream fin 3, the grip portion 3*a* does not reduce the flow cross-sectional area of the air-conditioning air in the air-conditioning register (ventilation passage 2).

(3) Regarding the rotation and slide movement of the downstream fin 3 by the user operation, it is advantageous to perform each of them against a certain amount of reaction force in order to precisely adjust the position of the downstream fin 3 during the rotation and slide movement. However, when the reaction force acting on the downstream fin 3 during the rotation and the reaction force acting on the downstream fin 3 during the slide movement are significantly different, the difference in the magnitude of the reaction force appears as a difference in the operation feeling of the downstream fin 3 by a user, which causes the user to feel a sense of discomfort. In order to suppress such a situation, it is necessary to adjust the rotation support portion (rotation shaft 7 and rotation hole 11) and the slide support portion (slider 10 and slide hole 9) so that the difference in the magnitude of the reaction force can be suppressed to a small extent. However, when the rotation support portion and the slide support portion are provided at the same position of the air-conditioning register, it becomes difficult to perform such adjustment. In this respect, since the rotation support portion and the slide support portion are provided at different positions of the air-conditioning register, it becomes easy to adjust the rotation support portion and the slide support portion so that the difference in the magnitude of the reaction force can be suppressed to a small extent.

(4) The rotation support portion is formed by the rotation shaft 7 and the rotation hole 11. Therefore, the magnitude of the reaction force during the rotation operation of the downstream fin 3 can be adjusted by, for example, adjusting the frictional resistance between the rotation shaft 7 and the rotation hole 11. Further, the slide support portion is formed by the slider 10 and the slide hole 9. Therefore, the magnitude of the reaction force during the slide movement operation of the downstream fin 3 can be adjusted by, for example, adjusting the frictional resistance between the slider 10 and the slide hole 9.

Second Embodiment

Next, a second embodiment of the air-conditioning register will be described with reference to FIGS. 8 to 11.

In the second embodiment, the rotation support portion and the slide support portion are different from those in the first embodiment. Further, in the second embodiment, only one downstream fin 3 is provided as the downstream fin.

Figure 8:
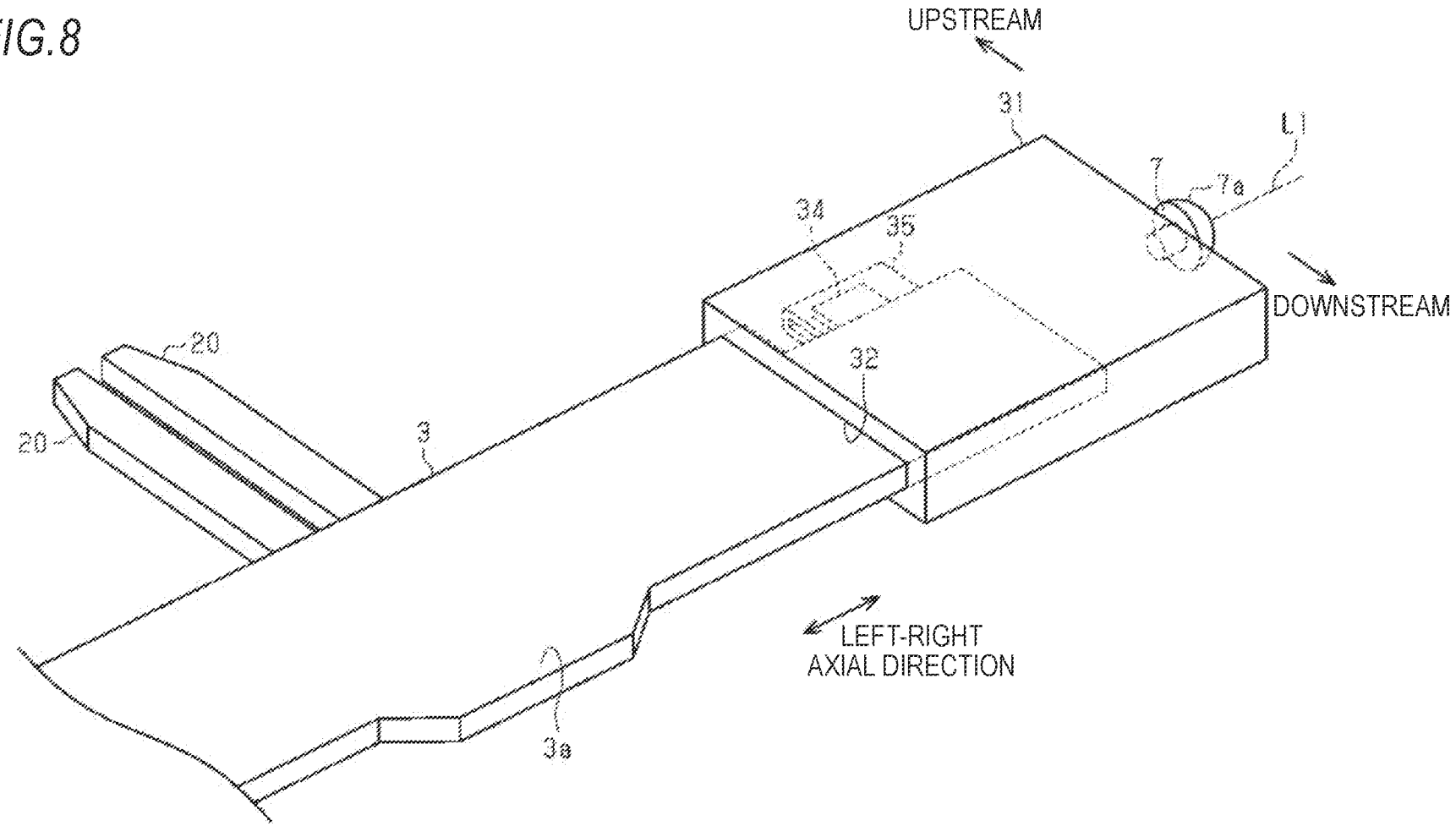
FIG. 8 is a perspective view illustrating the downstream fin and a tubular body.

As illustrated in FIG. 8, an end portion of the downstream fin 3 in the left-right axial direction is inserted into a slide cavity 32 of a tubular body 31 having the rotation shaft 7. The rotation shaft 7 extends in the left-right axial direction and serves as a first rotation shaft fixed to the tubular body 31. Further, the tubular body 31 is supported by the slide cavity 32 so that the downstream fin 3 can be slid and moved in the center line L1 direction of the rotation shaft 7 and cannot be rotated around the center line LL.

Figure 9:
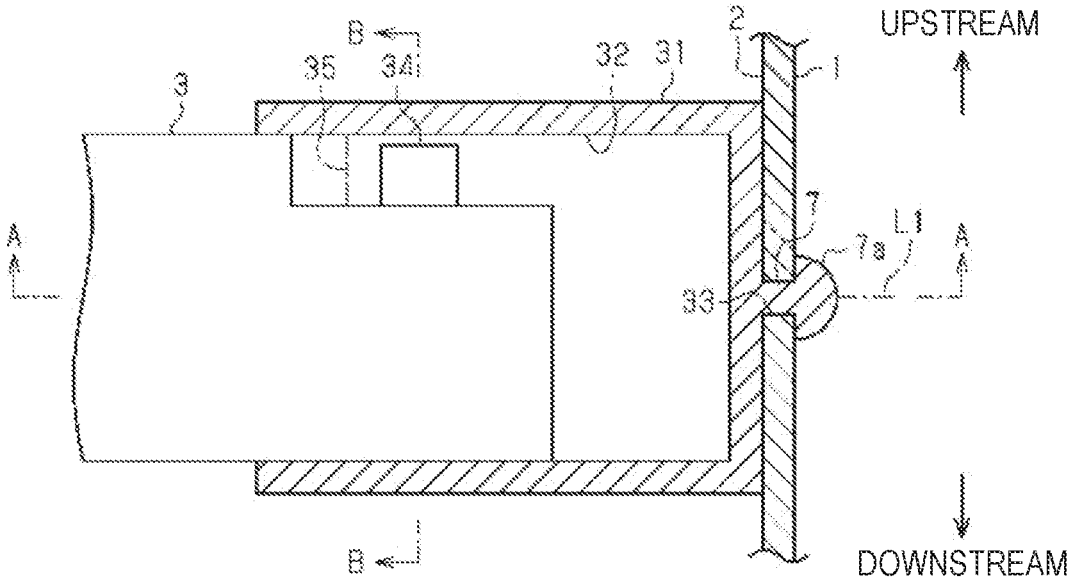
FIG. 9 is a cross-sectional view illustrating the tubular body into which an end portion of the downstream fin is inserted.
Figure 10:
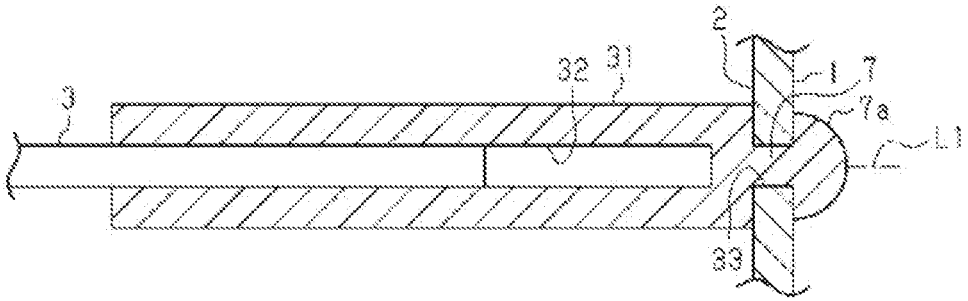
FIG. 10 is a cross-sectional view illustrating a state in which the end portion of the downstream fin and the tubular body are viewed from a direction of the arrow A-A in FIG. 9.

As illustrated in FIGS. 9 and 10, the retainer 1 is formed with a rotation hole 33 that supports the rotation shaft 7 of the tubular body 31 so that the rotation shaft 7 can rotate around the center line L1. Further, the retainer 1 is interposed between the large diameter portion 7*a* at the tip of the rotation shaft 7 and the tubular body 31. As a result, the tubular body 31 is prevented from sliding in the center line L1 direction of the rotation shaft 7. The downstream fin 3 is supported by the retainer 1 via the tubular body 31 and the rotation shaft 7.

In the air-conditioning register, a rotation support portion is formed by the rotation shaft 7 and the rotation hole 33 of the retainer 1 and a slide support portion is formed by the slide cavity 32 of the tubular body 31. These rotation support portion and slide support portion are also provided at different positions of the air-conditioning registers.

Figure 11:
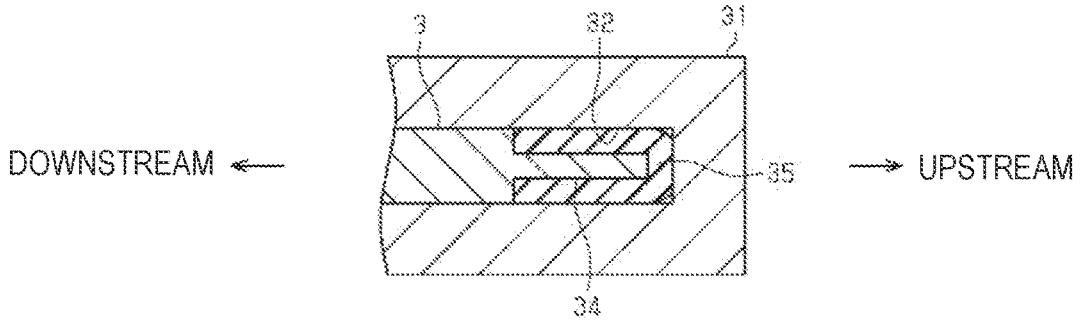
FIG. 11 is a cross-sectional view illustrating a state in which a protruding piece of the downstream fin and an elastic member are viewed from a direction of the arrow B-B in FIG. 9.

As illustrated in FIG. 11, a protruding piece 34 protruding toward the upstream side (right side in FIG. 11) is formed at a portion located inside the tubular body 31 at the upstream end of the downstream fin 3. The protruding piece 34 is covered with an elastic member 35 folded in two. The elastic member 35 is pressed against an inner wall of the slide cavity 32 of the tubular body 31. As a result, rattling of the downstream fin 3 with respect to the cylinder 31 is suppressed.

According to this embodiment, in addition to the effects of (1) to (3) of the first embodiment, the following effect can be obtained.

(5) The rotation support portion is formed by the rotation shaft 7 and the rotation hole 33. Therefore, magnitude of a reaction force during a rotation operation of the downstream fin 3 can be adjusted by, for example, adjusting frictional resistance between the rotation shaft 7 and the rotation hole 33. Further, the slide support portion is formed by the slide cavity 32 of the tubular body 31. Therefore, magnitude of a reaction force during a slide movement operation of the downstream fin 3 can be adjusted by, for example, adjusting the frictional resistance between the end portion of the downstream fin 3 and the slide cavity 32. As the adjustment of the frictional resistance between the end portion of the downstream fin 3 and the slide cavity 32, for example, a material of the elastic member 35 may be changed or the pressing strength of the elastic member 35 against the slide cavity 32 may be changed.

Third Embodiment

Next, a third embodiment of the air-conditioning register will be described with reference to FIGS. 12 to 15.

The third embodiment is different from the first embodiment in the rotation support portion and the slide support portion.

Figure 12:
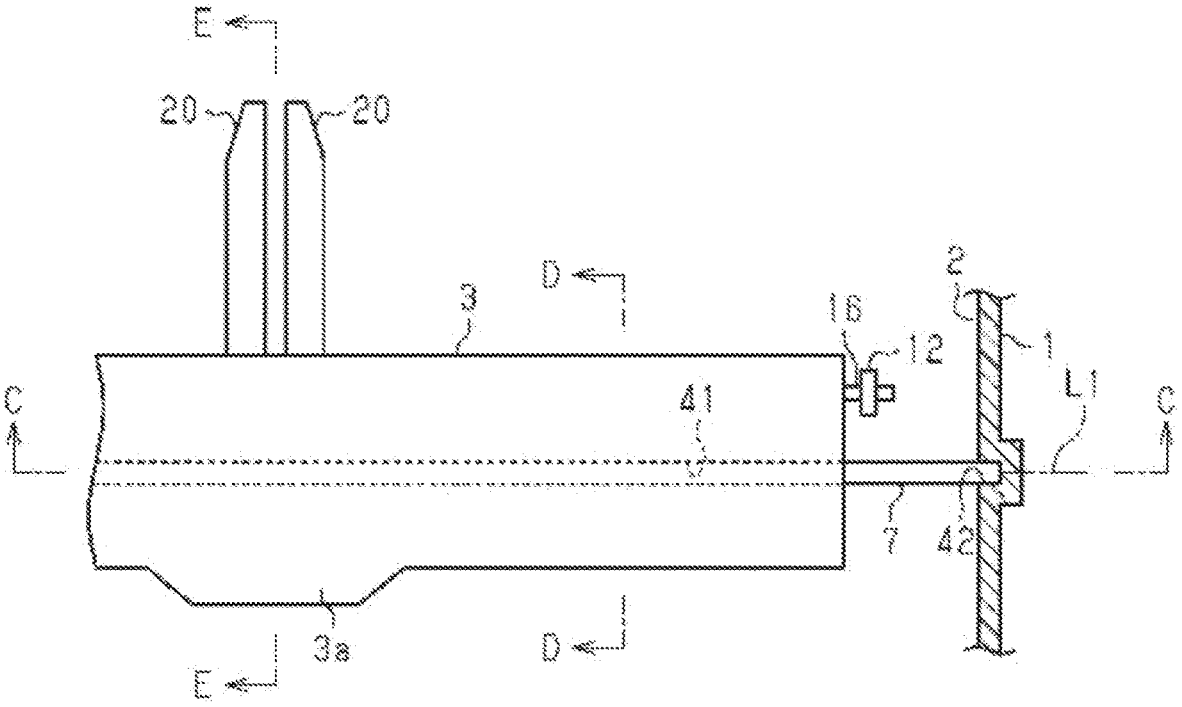
FIG. 12 is a plan view illustrating the downstream fin.

As illustrated in FIG. 12, the downstream fin 3 is formed with a slide groove 41 extending in the left-right axial direction of FIG. 12. The rotation shaft 7 (first rotation shaft) is fitted in the slide groove 41. The rotation shaft 7 is arranged so that its center line L1 extends in the same direction as the slide groove 41. Further, the rotation shaft 7 is designed so as to be able to slide and move in the center line L1 direction with respect to the slide groove 41 and not to rotate around the center line L1.

Figure 13:
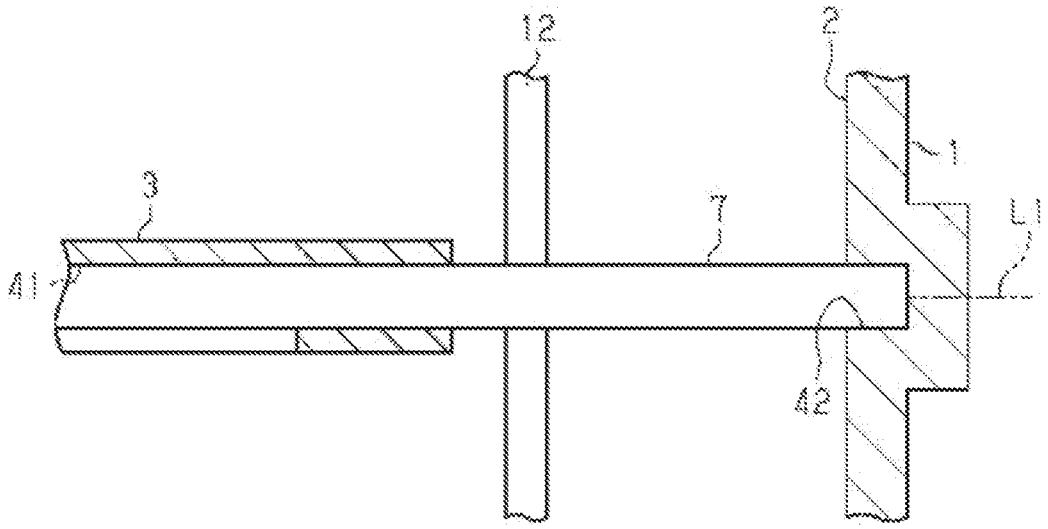
FIG. 13 is a cross-sectional view illustrating a state in which the downstream fin is viewed from a direction of the arrow C-C in FIG. 12.

As illustrated in FIG. 13, at an end portion of the slide groove 41, an opening of the slide groove 41 is closed so that the rotation shaft 7 does not come off from the slide groove 41. On the other hand, the retainer 1 is formed with a rotation cavity 42 which supports an end portion of the rotation shaft 7 so that the rotation shaft 7 can rotate around the center line L1. One end portion of the rotation cavity 42 is closed and the closed end portion regulates the sliding movement of the rotation shaft 7 in the center line L1 direction. The downstream fin 3 is supported by the retainer 1 via the rotation shaft 7.

Figure 14:
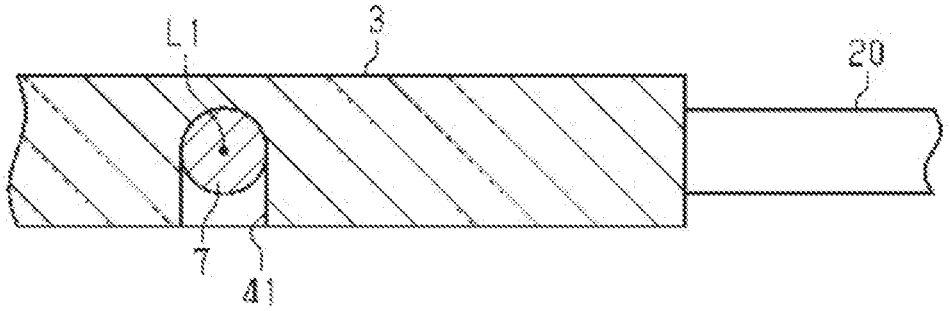
FIG. 14 is a cross-sectional view illustrating a state in which the downstream fin is viewed from a direction of the arrow D-D in FIG. 12.
Figure 15:
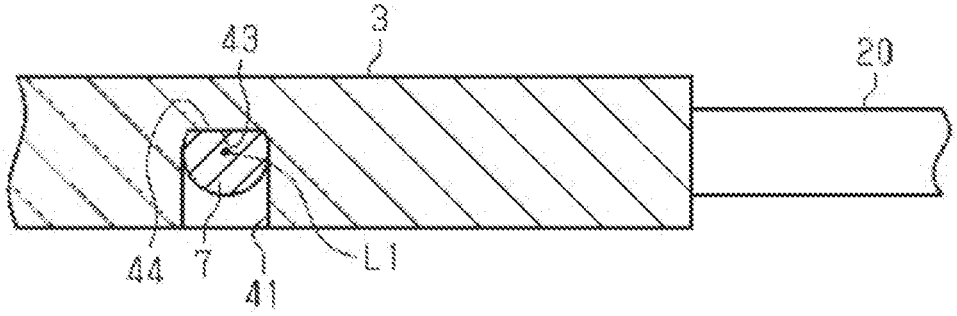
FIG. 15 is a cross-sectional view illustrating a state in which the downstream fin is viewed from a direction of the arrow E-E in FIG. 12.

FIGS. 14 and 15 respectively illustrate a state in which downstream fin 3 is viewed from a direction of the arrow D-D in FIG. 12 and a state in which the downstream fin 3 is viewed from a direction of the arrow E-E in FIG. 12. As can be seen from these figures, a bottom surface of the slide groove 41 has a flat portion 43 in a part in the extending direction (the direction orthogonal to the paper surface of FIGS. 14 and 15) of the slide groove 41. Further, a flat surface 44 in surface contact with the flat portion 43 is formed on a portion of the rotation shaft 7 facing the flat portion 43. Then, due to surface contact between the flat portion 43 of the slide groove 41 and the flat surface 44 of the rotation shaft 7, the downstream fin 3 can slide in the center line L1 direction with respect to the rotation shaft 7 and cannot rotate around the center line L1.

In the air-conditioning register, a rotation support portion is formed by the rotation shaft 7 and the rotation cavity 42 of the retainer 1 and a slide support portion is formed by the rotation shaft 7 (flat surface 44) and the slide groove 41 (flat portion 43). These rotation support portion and slide support portion are also provided at different positions of the air-conditioning register.

According to this embodiment, in addition to the effects of (1) to (3) of the first embodiment, the following effect can be obtained.

(6) The rotation support portion is formed by the rotation shaft 7 and the rotation cavity 42. Therefore, magnitude of a reaction force during a rotation operation of the downstream fin 3 can be adjusted by, for example, adjusting frictional resistance between the rotation shaft 7 and the rotation cavity 42. Further, the slide support portion is formed by the flat surface 44 of the rotation shaft 7 and the flat portion 43 of the slide groove 41. Therefore, magnitude of a reaction force during a slide movement operation of the downstream fin 3 can be adjusted by, for example, adjusting frictional resistance between the flat surface 44 and the flat portion 43.

Other Embodiments

Each of the embodiments described above can be changed as follows, for example. Each of the embodiments described above and the following modification examples can be implemented in combination with each other within a technically consistent range.

In the first to third embodiments, the rotation support portion and the slide support portion do not necessarily have to be provided at different positions of the air-conditioning register.

In the first to third embodiments, the thickness of the grip portion 3*a* may be smaller than the thickness of the downstream fin 3.

In the first to third embodiments, the grip portion 3*a* does not necessarily have to be formed in the downstream fin 4.

In the first to third embodiments, the rotation direction and slide movement direction of the downstream fin 3, the rotation direction of the downstream fin 4, and the rotation direction of the upstream fins 5 and 6 may be appropriately changed. For example, it is conceivable that the downstream fin 3 is rotated in a horizontal direction (the left-right axial direction in FIG. 1) and slides in the up-down axial direction, the downstream fin 4 is rotated in the horizontal direction, and the upstream fins 5 and 6 are rotated in the up-down axial direction.

In the first to third embodiments, the upstream fin 6 and the link 15 may be omitted.

In the first and third embodiments, the downstream fin 4 and the link 12 may be omitted.

What is claimed is:

1. An air-conditioning register comprising:

a downstream fin; and an upstream fin, wherein:

the downstream fin and the upstream fin are provided in a ventilation passage which allows air-conditioning air to flow;

the downstream fin is rotatable around a center line of a first rotation shaft;

the upstream fin is rotatable around a center line of a second rotation shaft further on an upstream side than the downstream fin in the ventilation passage;

the second rotation shaft extends in a direction different from that of the first rotation shaft; and the downstream fin is slidable in a center line direction of the first rotation shaft and has a driving unit which presses the upstream fin in a slide movement direction as the downstream fin slides, wherein the downstream fin is supported by a rotation support portion so as to be rotatable around the center line of the first rotation shaft and is supported by a slide support portion so as to be slidable in the center line direction of the first rotation shaft, and the rotation support portion and the slide support portion are provided at different positions, the first rotation shaft is fixed to the downstream fin;

the ventilation passage is formed in a retainer;

the retainer is formed with a slide hole which supports a slider so that the slider can be slidably moved in the center line direction of the first rotation shaft;

the slider is formed with a rotation hole which rotatably supports the first rotation shaft;

the downstream fin is supported by the retainer via the first rotation shaft and the slider;

the rotation support portion is formed by the first rotation shaft and the rotation hole of the slider; and the slide support portion is formed by the slider and the slide hole of the retainer.

2. The air-conditioning register according to claim 1, wherein at a downstream end of the downstream fin, a grip portion having a thickness equal to or less than a thickness of the downstream fin is formed so as to protrude.

* * * * *